United States Patent [19]

Schreurs

[11] 4,061,946

[45] Dec. 6, 1977

[54] FLUORESCENT LAMP HAVING ZERO BACK BRIGHTNESS

[75] Inventor: Willy P. Schreurs, Danvers, Mass.

[73] Assignee: GTE Sylvania Incorporated, Danvers, Mass.

[21] Appl. No.: 619,721

[22] Filed: Oct. 6, 1975

[51] Int. Cl.[2] ..... H01J 1/62

[52] U.S. Cl. ..... 313/488; 313/489

[58] Field of Search ..... 313/111, 485–489, 313/493

[56] References Cited

U.S. PATENT DOCUMENTS

| | | | |
|---|---|---|---|
| 3,026,436 | 3/1962 | Hughes | 313/485 |
| 3,225,241 | 12/1965 | Spencer et al. | 313/488 |

*Primary Examiner*—M. Tokar

*Attorney, Agent, or Firm*—James Theodosopoulos

[57] ABSTRACT

In a directional fluorescent lamp having a reflector layer between the phosphor and the glass envelope wall, there is a dark, nonreflecting, light-absorbing layer between the reflector layer and the glass to prevent light escaping from the back of the lamp.

4 Claims, 1 Drawing Figure

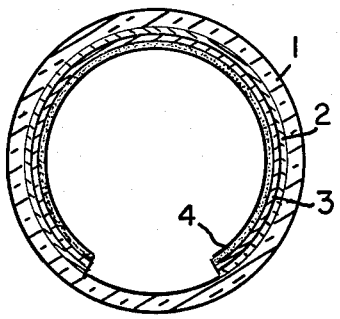
1
2
3
4

FLUORESCENT LAMP HAVING ZERO BACK BRIGHTNESS

BACKGROUND OF THE INVENTION

1. Field of the Invention

This invention concerns directional fluorescent lamps. A directional fluorescent lamp comprises a tubular glass envelope having an electrode at each end, a phosphor coating on the envelope wall to convert the ultraviolet radiation from the low pressure mercury arc to visible radiation, and a reflector coating on a major portion of the envelope wall. The light is transmitted through that portion of the envelope wall which is void of reflector coating.

One example of a directional fluorescent lamp is an aperture lamp in which neither the phosphor nor the reflector covers the entire envelope, thereby leaving a longitudinal window through which most of the light is emitted. Examples of aperture lamps are shown in U.S. Pat. Nos. 3,067,356, 3,225,241, 3,717,781, 3,809,944, 3,875,454, 3,875,455 and 3,886,396.

2. Description of the Prior Art

There are three types of coatings that are commonly used in fluorescent lamps, in addition to the phosphor coating.

First, there is a protective coating used to prevent or reduce solarization as discussed in U.S. Pat. No. 3,676,729. Such coatings are transparent to visible light and can comprise the oxides of titanium, aluminum, silicon, zirconium, hafnium, niobium, tantalum, antimony, tin, boron and indium as disclosed in U.S. Pat. Nos. 3,067,356, 3,377,494, 3,541,377, 3,624,444, 3,676,729, 3,875,454 and 3,890,530.

Second, there are electrically conductive coatings used to aid lamp ignition. Such coatings are transparent to visible light and can comprise tin oxide or indium oxide as disclosed in U.S. Pat. Nos. 3,624,444 and 3,809,944.

Third, there are reflector coatings to reflect the light in a particular direction. Such coatings can comprise the oxides of titanium, magnesium or zinc as disclosed in U.S. Pat. Nos. 3,115,309, 3,225,241 and 3,379,917.

The prior art does not disclose or suggest the use of dark, nonreflective, light-absorbing coatings in fluorescent lamps. The FIGURE is a cross sectional view of a directional fluorescent lamp.

THE INVENTION

This invention concerns a directional fluorescent lamp which has a dark, nonreflecting, light-absorbing coating between the reflector layer and the glass in order to eliminate light transmission from the back of the lamp.

In special applications using reflector-type fluorescent lamps, specifically, in photocopying applications, any light transmitted out the back of the lamp, that is, through the reflecting portion, can reduce the clarity or sharpness of the image on the copy.

The amount of light that passes out the back of the lamp can be expressed as a ratio in terms of the amount of light transmitted through the forward portion of the lamp. A typical example of the amount of light emanating from the 330° back portion of a 30° aperture lamp used in photocopy applications is one unit of light from behind the 330° reflecting surface to forty units of light from the forward surface of the reflector passing through the 30° aperture so that the back lightto front light ratio is one to forty. This ratio can be reduced to zero by interposing a layer of dark, nonreflecting, light-absorbing material between the glass and the reflector layer. This dark layer should be electrically nonconducting so that it will not interfere with lamp ignition.

Several 30° 18T8 aperture lamps having the dark coating between the glass and the reflector and having a zero back light transmission showed sharp contrasting prints when used in photocopying machines, resulting in improved printing appearance.

The light from behind the reflector layer, when the dark coating is not used, reflects into the optical system employed by the copy machines and interferes with the directly transmitted light, generally causing the print to appear less distinct than when lamps are employed having the black coating.

The single FIGURE in the drawing is a cross-sectional view of a fluorescent lamp in accordance with this invention.

One example of a lamp in accordance with this invention was prepared in the following manner. A glass lamp envelope seventeen inches long by one inch diameter, was washed and dried in the usual manner. Dark layer 2 was then applied to the inside surface of envelope 1 from a liquid suspension of a black pigment. The suspension consisted of 300 grams of black glaze Z-560 and 20 ml of tricresyl phosphate plasticizer in 250 ml of a nitrocellulose vehicle which had been milled for 24 hours in a quart pebble mill and had been adjusted to a specific gravity of 1.065. The nitrocellulose vehicle consisted of, by weight, 2% of 1000 second nitrocellulose, 1% ethanol, 95% butyl acetate and 2% diethyl phthalate. Black glaze Z-560 is the name for a fine black powder manufactured by Harshaw Chemical Co. which consists of mixed oxides of iron, manganese and cobalt and which has an average particle size of 0.3 microns. Only 330° of the bulb circumference was coated with dark layer 2 leaving an aperture of 30° of uncoated glass. After drying, the envelope was baked at 600° C for approximately three minutes to eliminate the nitrocellulose from dark layer 2 and to adhere layer 2 to the glass.

Reflector layer 3 was then formed on dark layer 2 by depositing thereon a reflector material, for example, titanium dioxide in suspension in nitrocellulose and butyl acetate. The suspension was poured into the horizontal envelope which was then rolled so as to coat 330° of the bulb circumference, leaving the 30° aperture uncoated. After reflector layer 3 dried, a fluorescent phosphor 4 was deposited thereon. The phosphor used was manganese activated gallium magnesium oxide, a green-emitting phosphor often used in the lamps of photocopy apparatus. The phosphor was applied from a suspension of phosphor in an ethylcellulose-xylol coating system. Again the envelope was rolled during coating, so that phosphor 4 coated 330° of the envelope, leaving the aperture free of coating. After drying, the envelope was baked at 600° C to eliminate organic matter and was then processed into a finished lamp in the usual manner of lamp manufacture.

The light output from the lamp was measured in the following manner. A calibrated photocell was placed directly in front of the lamp aperture and a reading of forty micro-ampere light output units was obtained. Placing the photocell in back of the reflector portion of the lamp gave a reading of zero micro-ampere light output units. Control lamps measured in the same manner gave forty micro-amperes light output units in front of the aperture and one micro-ampere light output units in back of the reflector coating in lamps which did not have the dark coating. Placing the lamp having the black oxide coating in a photocopy machine and examining the resulting printed copy showed better quality printing when compared to printing obtained from lamps not having the black coating.

In order to extend lamp life, aperture lamps in accordance with this invention should have a transparent protective coating at least on the aperture portion thereof.

I claim:

1. In a directional fluorescent lamp of the type comprising a tubular glass envelope having a reflector coating sandwiched between a phosphor layer and the glass envelope, the improvement which comprises a dark, nonreflecting, electrically nonconducting light-absorbing layer between the reflector coating and the glass envelope.

2. The lamp of claim 1 wherein said lamp is an aperture lamp and wherein both the reflector coating and the phosphor layer extend the entire circumference of the envelope except the aperture.

3. The lamp of claim 2 wherein the aperture has a transparent protective coating thereon.

4. The lamp of claim 1 wherein said dark layer is composed of the mixed oxides of iron, manganese and cobalt.

* * * * *